US005782280A

United States Patent [19]

Berry

[11] Patent Number: 5,782,280

[45] Date of Patent: Jul. 21, 1998

[54] COIN PURSE

[76] Inventor: Rawnie J. Berry, 43 N. 23rd St., Reading, Pa. 19606

[21] Appl. No.: 787,863

[22] Filed: Jan. 23, 1997

[51] Int. Cl.[6] ..... A45C 1/04

[52] U.S. Cl. ..... 150/113; 150/112; 206/0.82; 206/0.83

[58] Field of Search ..... 206/0.8, 0.81–0.84, 206/0.815, 232; 150/136, 152, 112, 115, 113; 224/668–670; 383/40

[56] References Cited

U.S. PATENT DOCUMENTS

| | | | |
|---|---|---|---|
| D. 136,425 | 10/1943 | Behrman | 206/0.82 |
| 1,679,500 | 8/1928 | Sanford | 206/0.81 |
| 2,185,359 | 1/1940 | Swanson | 206/0.83 |
| 2,252,586 | 8/1941 | Swanson | 150/136 |
| 2,361,716 | 10/1944 | Swanson | 206/0.84 |
| 2,390,748 | 12/1945 | Swanson | 206/0.81 |
| 2,802,500 | 8/1957 | June | 150/136 |
| 3,062,364 | 11/1962 | Ziemski | 150/136 |
| 4,917,160 | 4/1990 | Hart et al. | 150/112 |
| 5,102,234 | 4/1992 | Levy | 383/40 |
| 5,275,438 | 1/1994 | Struhl | 206/232 |

*Primary Examiner*—Jimmy G. Foster
*Attorney, Agent, or Firm*—John Lezdey

[57] ABSTRACT

There is provided the combination of a purse and a coin holder which can be formed in a single molding operation. The purse is a flexible plastic sheet having a plurality of folds so as to form a front wall, a bottom wall and a top wall with the coin holder. The top wall has an extended flap and a closure. The coin holder can be attached about the bottom portion of the purse and is formed with a plurality of U-shaped members for holding and dispensing coins.

7 Claims, 3 Drawing Sheets

COIN PURSE

FIELD OF THE INVENTION

The present invention relates to a purse and coin holder. More particularly, there is provided an inexpensive molded purse having a coin holder which can be easily constructed and does not have any exposed hinges or tabs.

BACKGROUND OF THE INVENTION

It is useful to provide a carrying purse which can provide easy access to coins and tokens. However, it is preferred in most cases to be able to segregate the coins and/or tokens so as to quickly dispense the different coins. The requirement for exact change on public transportation and at toll booths on highways together with inflation has required that a person carries many coins and to have them readily available so as to avoid delays. It is also desired that such coin holders have an aesthetic appearance.

U.S. Pat. No. 2,019,035 to Amsterdam discloses a hand bag with a coin or token holder which is concealed by a pair of straps. However, different varieties of coins cannot be carried and easily dispensed.

U.S. Pat. No. 2,201,757 to Bender discloses a hand bag which contains a slot for dispensing only one kind of coin or token.

U.S. Pat. No. 2,361,716 to Swanson discloses a coin purse which contains U-shaped coin holders which are fastened to metal ribs at the bend of the purse. Such purse is expensive to manufacture and uncomfortable when carrying on the person such as when wearing athletic garments.

SUMMARY OF THE INVENTION

According to the invention there is provided the combination of a purse and coin holder. Each of the components are formed by molding plastic materials. Preferably, both are formed in the same mold.

The purse comprises a flexible plastic sheet having a plurality of bends or folds which form a front wall, a top wall and a bottom wall integrally interconnecting the front wall. The top wall has an integral extension having a plurality of bends which forms the top wall and an overhanging flap. Preferably, the flap has means for attaching the flap to the outside of a coin holder. The purse is formed with at least one pocket by fusing or heat sealing a plastic film to the inner side of the front wall.

The coin holder comprises a molded plastic having a plurality of U-shaped channelled members which can hold a plurality of different coins or tokens. Advantageously, the coin holder is attached to the bottom wall of the purse, for example, by means of a hook and eye (Velcro) fastener, slot or adhesive.

It is therefore an object of the invention to provide an inexpensive molded coin dispensing purse.

It is another object of the invention to provide a purse having a means for holding and dispensing a multiplicity of coins which can be carried without the appearance of bulk.

Further objects and advantages will become apparent from the following description and the accompanying drawings.

DESCRIPTION OF THE PREFERRED EMBODIMENTS

Figure 1:
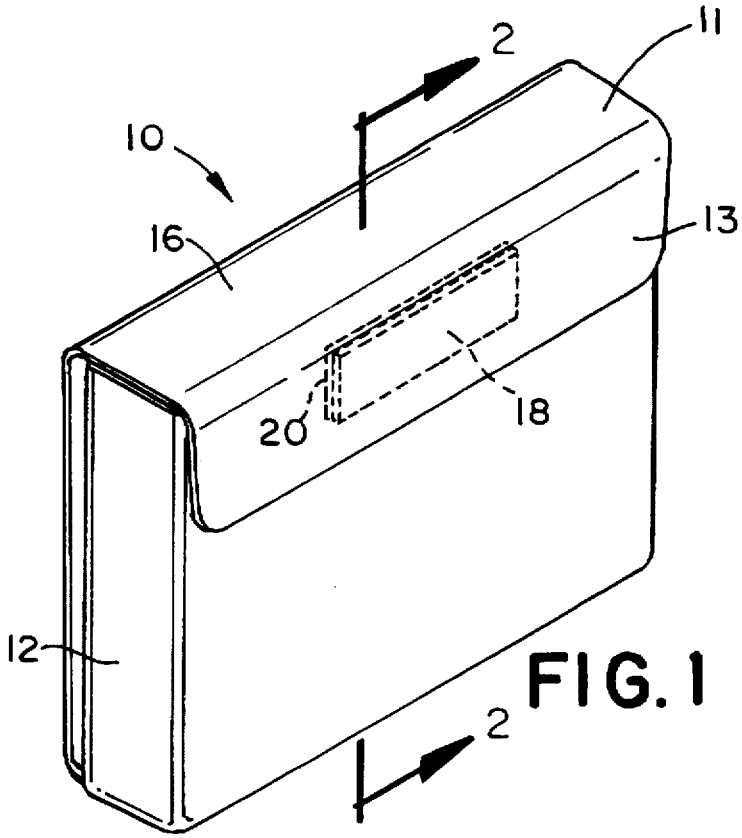
FIG. 1 is a front perspective view of a purse and coin holder embodying the invention.
Figure 2:
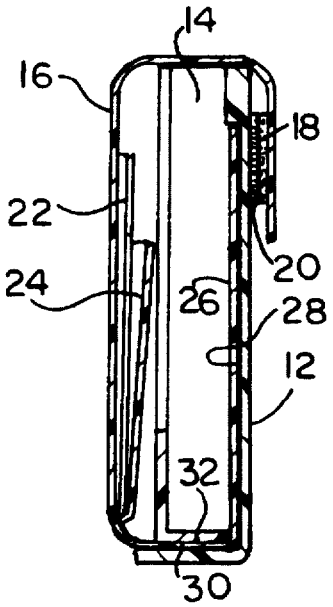
FIG. 2 is a cross-sectional side view of the purse and coin holder of FIG. 1 taken along line 2—2.
Figure 3:
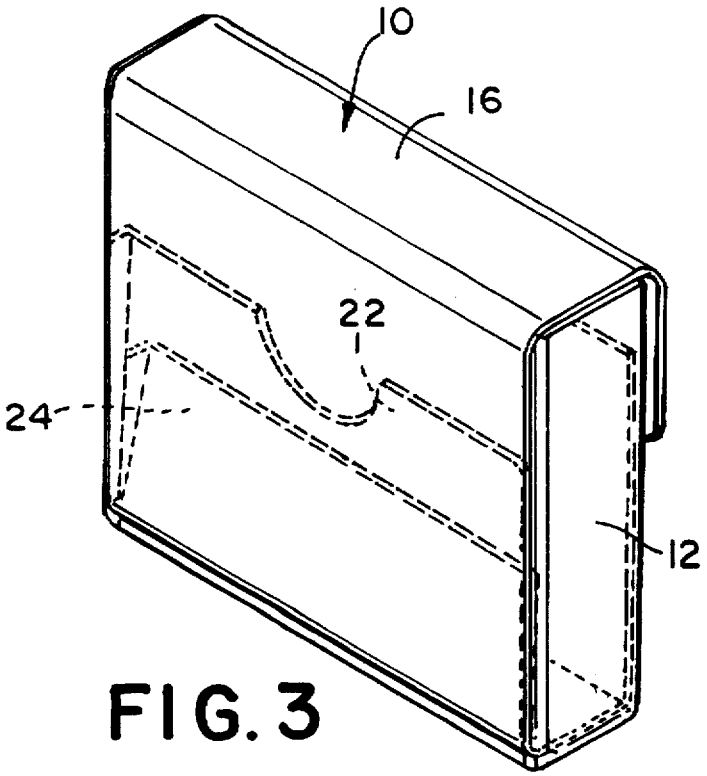
FIG. 3 is a rear perspective view of the purse and coin holder of FIG. 1.

Referring now to the various figures of the drawings wherein like reference characters refer to like parts, there is shown a molded purse and coin holder 10 constructed in accordance with the instant invention. FIGS. 1—3 show the purse and coin holder 10 in a closed position with the coin holder 12 forming the side walls. The top wall 11 of the purse 16 has a hook 20 and eye 18 fastener (Velcro®) on the flap 13 which maintains the purse 16 in a closed position. Within the purse are pockets 22 and 24 which can be formed by heat sealing a pair of film layers to the inner side of the back wall of the purse 16.

Figure 4:
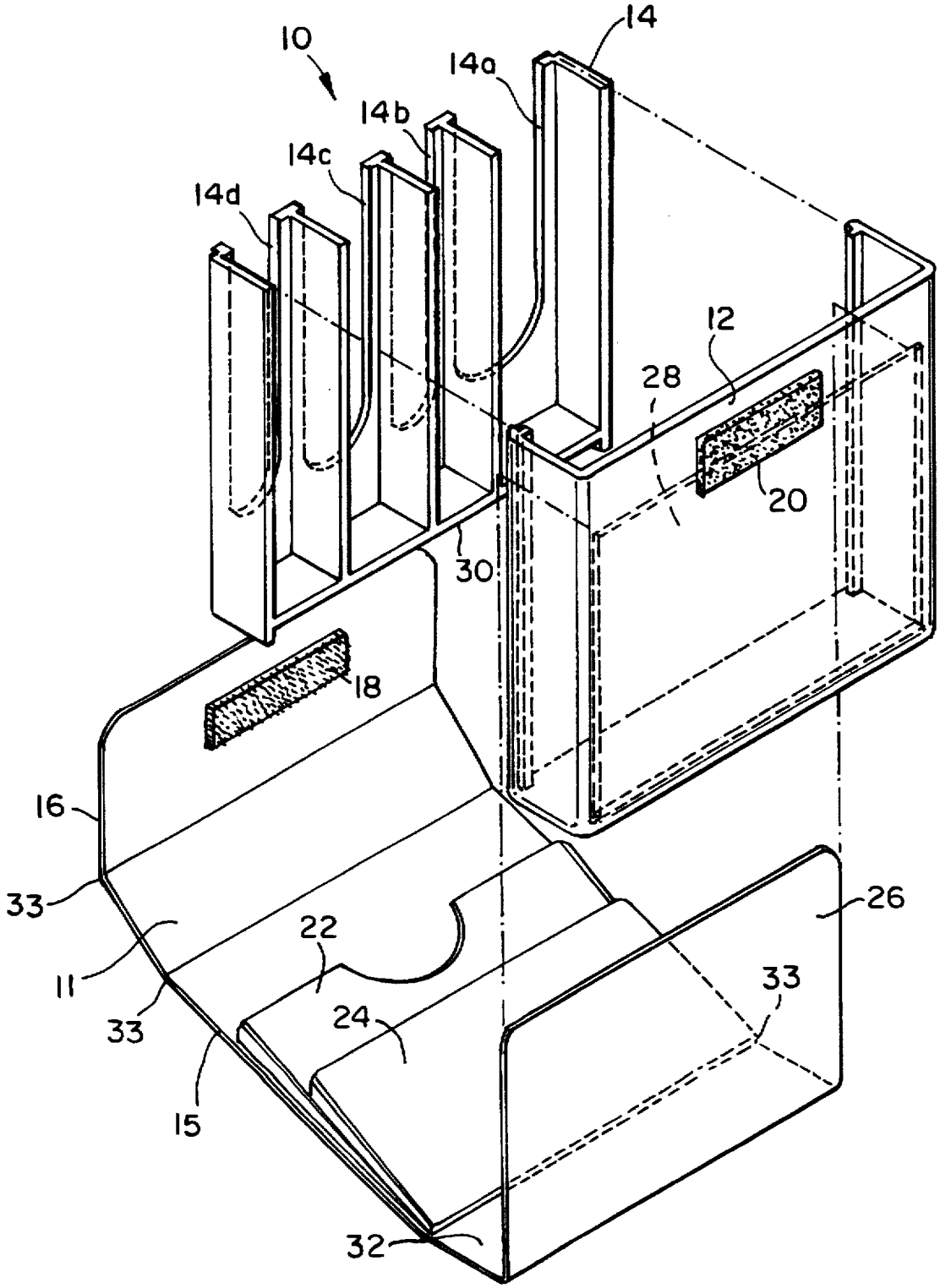
FIG. 4 is an exploded view of the purse and coin holder of FIG. 1.

As shown in FIG. 4 the purse 16 can be formed in a molding process utilizing a single plastic sheet and be provided with a plurality of bends or folds 33 having a memory so as to form the flap 13, top wall 11, back wall 15 and front wall 26. The pockets 22,24 can be formed by laminating or heat sealing the edges of films onto the purse 16.

The coin holder 12 can be formed by one or two molded sections. As seen in FIG. 4, a two part construction is formed by a plastic frame 14 having a plurality of upwardly projecting arms 14*a*, 14*b*, 14*c*, 14*d* forming a U-shaped compartment of different widths for holding different sized tokens or coins. The arms 14*a*, 14*b*, 14*c*, 14*d* are flexible and provide sufficient resistance to hold the coins or tokens. The frame 14 fits into the plastic housing 28 which can be attached to the purse on the inner surface of the front wall 26 or bottom wall 32. The attachment can be by any suitable adhesive means or through use of a hook and eye fastener (Velcro®).

As shown in FIGS. 1 and 3, the coin holder forms the side walls of the closed purse.

It is understood that the frame 14 can be removable from the housing 28 or permanently attached, for example, by an adhesive. A removable frame permits use of the housing 28 to carry other items or equipment when the coin holder is not required, for example, a cosmetic case or a recording device.

Figure 5:
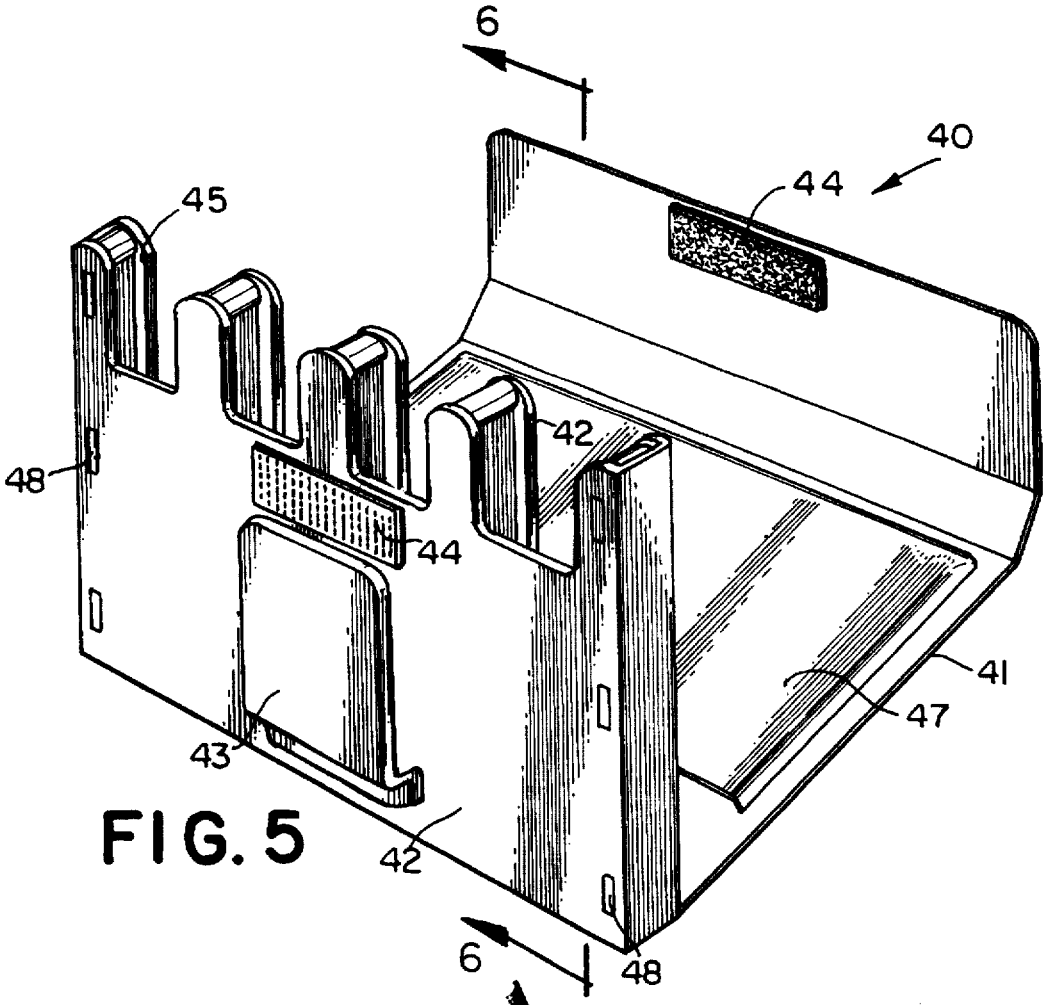
FIG. 5 is a front perspective view of another purse and coin holder of the invention.
Figure 6:
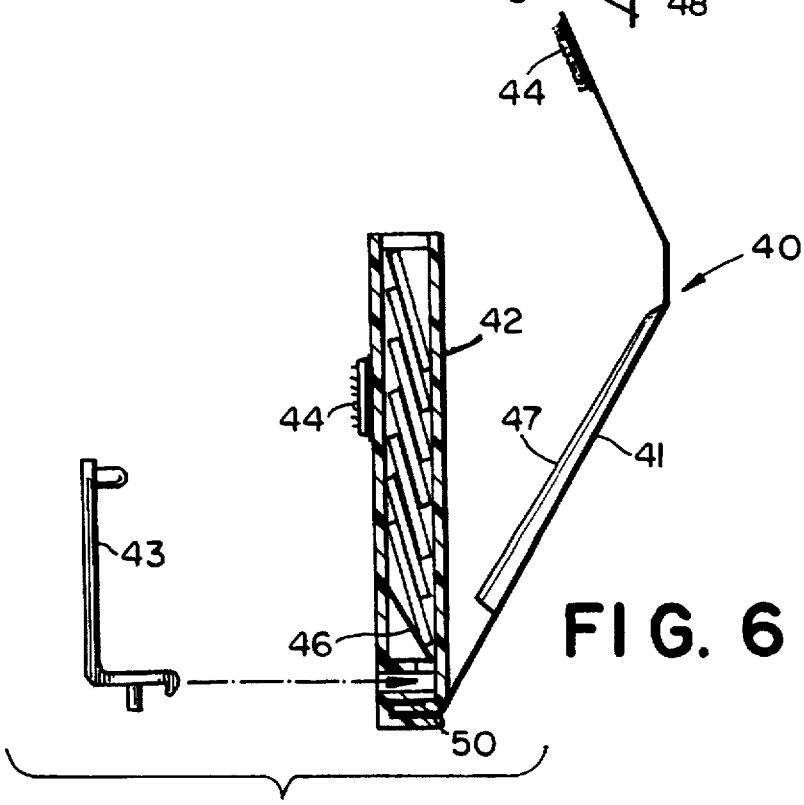
FIG. 6 is a cross-sectional side view of the purse and coin holder of FIG. 5 taken along line 6—6.

As shown in FIGS. 5 and 6, the purse and coin holder 40 of the invention with pocket 47 on the inside of the back wall 41 can be provided with an optional belt clip 43 which is attached to the outside wall of the coin holder 42. The purse portion has its bottom wall attached within a slot 50 of the coin holder 40. On the extending flap of the top wall of the purse is a velcro strip 44 which mates with the velcro strip on the outside wall of the coin holder 42. Preferably, the outside wall of the coin holder 42 is a separate part which snaps onto a rib or peg 48. The coin holder 42 has an angular bottom wall 46 so that the coins are placed at an angle for easier dispensing.

The purse portion can be easily manufactured so as to be held in slot 50 because of the removable outside wall which presses against the portion within the slot 50.

The purse and coin holder can be molded from any suitable thermoplastic material depending upon the flexibility or feel desired. Suitable resins for use in the molding process for ABS, polyvinyl acetate, polyvinyl alcohol, polyethylene terephthalate, polyolefin, or the like.

Conveniently, the purse and the coin holder can be molded in a single mold.

It is evident from the foregoing that the invention is not limited to the specific details and arrangement of parts shown and described herein for illustration and that changes and variations may be resorted to coming within the scope of the appended claims.

I claim:

1. The combination of a molded purse and coin holder, said purse comprising:

a) a flexible mold plastic sheet having a plurality of bends or folds which form a front wall, a top wall and a bottom wall integrally interconnected to the front wall, said top wall having an integral extension which forms and an overhanging flap;

b) at least one plastic film sheet fused to the inner surface of said front wall to form a pocket within said purse;

c) a molded plastic coin holder comprising a plurality of integrally connected flexible U-shaped channelled members for holding and dispensing coins, said coin holder is connected to said bottom wall by a hook and eye fastener.

2. The combination of claim 1, wherein said flap is connected to the outer surface of said coin holder by a hook and eye fastener.

3. The combination of claim 1, wherein said purse and said coin holder are formed in the same mold.

4. The combination of claim 1, wherein two films are laminated to said inner surface of said front wall so as to form two inner pockets.

5. The combination of claim 1 wherein said coin holder comprises a removable frame having upwardly projecting arms for holding coins, said frame forming the side walls of said purse.

6. The combination of claim 5 wherein said frame is attached to said housing.

7. The combination of a molded purse and coin holder, said purse comprising:

a) a flexible mold plastic sheet having a plurality of bends or folds which form a front wall, a top wall and a bottom wall integrally interconnected to the front wall, said top wall having an integral extension which forms and an overhanging flap;

b) at least one plastic film sheet fused to the inner surface of said front wall to form a pocket within said purse;

c) a molded plastic coin holder comprising a plurality of integrally connected flexible U-shaped channelled members for holding and dispensing coins, said coin holder being attached to a wall of said purse; and d) a clip attached to an outer surface of said coin holder.

* * * * *